US006341420B1

(12) United States Patent
Swartz et al.

(10) Patent No.: US 6,341,420 B1
(45) Date of Patent: Jan. 29, 2002

(54) METHOD OF MANUFACTURING A DEVELOPER ROLLER

(75) Inventors: Edwin Swartz; Eugene H. Thomas, both of Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 09/630,910

(22) Filed: Aug. 2, 2000

(51) Int. Cl.[7] ..... B21D 53/00; B25F 5/02

(52) U.S. Cl. ..... 29/895.32; 492/49; 492/53

(58) Field of Search ..... 492/56, 49, 53; 29/895, 895.1, 895.3, 895.32, 895.33; 47/458, 475, 483, 485, 486

(56) References Cited

U.S. PATENT DOCUMENTS

| | | | | |
|---|---|---|---|---|
| 48,453 | A | | 6/1865 | Sentell |
| 3,040,704 | A | | 6/1962 | Bliss |
| 3,219,014 | A | | 11/1965 | Mott et al. |
| 3,770,482 | A | * | 11/1973 | Millar et al. ..... 427/458 |
| 3,863,603 | A | | 2/1975 | Buckley et al. |
| 4,018,601 | A | | 4/1977 | Hagenbach |
| 4,034,709 | A | | 7/1977 | Fraser et al. |
| 4,271,784 | A | | 6/1981 | Ishimoto et al. |
| 4,299,900 | A | | 11/1981 | Mitsubshi et al. |
| 4,331,101 | A | | 5/1982 | Muller et al. |
| 4,368,971 | A | | 1/1983 | Watanabe |
| 4,517,274 | A | | 5/1985 | Honda et al. |
| 4,564,285 | A | | 1/1986 | Yasuda |
| 4,700,450 | A | | 10/1987 | Michel |
| 4,745,429 | A | | 5/1988 | Mukai |
| 4,748,472 | A | | 5/1988 | Mukai |
| 4,806,992 | A | | 2/1989 | Yasuda et al. |
| 4,866,480 | A | | 9/1989 | Hosoya et al. |
| 4,870,461 | A | | 9/1989 | Watanabe et al. |
| 4,876,574 | A | | 10/1989 | Tajima et al. |
| 4,943,504 | A | | 7/1990 | Tomura |
| 4,954,404 | A | | 9/1990 | Inoue |
| 4,957,840 | A | | 9/1990 | Sakashita et al. |
| 4,982,689 | A | | 1/1991 | Honda et al. |
| 4,985,327 | A | | 1/1991 | Sakashita et al. |
| 4,987,454 | A | | 1/1991 | Natsuhara |
| 4,989,044 | A | | 1/1991 | Nishimura et al. |
| 5,027,745 | A | | 7/1991 | Yamazaki et al. |
| 5,052,335 | A | | 10/1991 | Enoguchi et al. |
| 5,149,914 | A | | 9/1992 | Koga et al. |
| 5,155,532 | A | | 10/1992 | Sakurada |
| 5,162,608 | A | | 11/1992 | Matsuda et al. |
| 5,175,586 | A | | 12/1992 | Goseki et al. |

(List continued on next page.)

FOREIGN PATENT DOCUMENTS

| | | | |
|---|---|---|---|
| EP | 0632242 | | 6/1994 |
| GB | 2088252 | | 6/1982 |
| JP | 50543679 | | 3/1980 |
| JP | 5647926 | | 4/1981 |
| JP | 5741676 | A | 3/1982 |
| JP | 63241187 | | 10/1988 |
| JP | 63253954 | | 10/1988 |
| JP | 02116857 | | 5/1990 |
| JP | 2290978 | | 11/1990 |
| JP | 04141685 | A | 1/1992 |
| JP | 4141685 | A | 5/1992 |
| JP | 5142949 | | 6/1993 |
| JP | 5266457 | A | 10/1993 |
| JP | 06230676 | | 8/1994 |
| JP | 6238945 | A | 8/1994 |

*Primary Examiner*—S. Thomas Hughes
*Assistant Examiner*—Marc Jimenez
(74) *Attorney, Agent, or Firm*—William London

(57) ABSTRACT

A Method of Manufacturing a Developer Roller in which a wetting agent is added to a polymer and graphite to ensure thorough dispersion of the graphite. The developer roller's performance is further improved by spray applying a surface layer of graphite and wetting agent and burnishing this surface layer after spray application. Additional improvements are seen by using many multiple steps of spraying thin coats to improve adhesion between the spray applied coats.

39 Claims, 4 Drawing Sheets

U.S. PATENT DOCUMENTS

| | | | | | |
|---|---|---|---|---|---|
| 5,177,322 | A | | 1/1993 | Nishimura et al. | |
| 5,185,496 | A | | 2/1993 | Nishimura et al. | |
| 5,202,729 | A | | 4/1993 | Miyamoto et al. | |
| 5,213,715 | A | * | 5/1993 | Patterson et al. | 252/518 |
| 5,215,845 | A | | 6/1993 | Yusa et al. | |
| 5,223,669 | A | | 6/1993 | Kanba et al. | |
| 5,227,849 | A | | 7/1993 | Katsumi et al. | |
| 5,255,059 | A | | 10/1993 | Kai et al. | |
| 5,274,426 | A | | 12/1993 | Goseki et al. | |
| 5,286,917 | A | | 2/1994 | Unno et al. | |
| 5,302,419 | A | * | 4/1994 | Muzzy | 427/485 |
| 5,309,206 | A | | 5/1994 | Deishi | |
| 5,325,637 | A | | 7/1994 | Yasuda et al. | |
| 5,400,630 | A | | 3/1995 | Okumura et al. | |
| 5,411,779 | A | * | 5/1995 | Nakajima et al. | 492/59 |
| 5,483,326 | A | | 1/1996 | Kosmider | |
| 5,547,724 | A | | 8/1996 | Kuribayashi | |
| 5,563,690 | A | | 10/1996 | Hasegawa et al. | |
| 5,608,502 | A | | 3/1997 | Yamashita et al. | |
| 5,618,647 | A | | 4/1997 | Kukimoto et al. | |
| 5,655,196 | A | | 8/1997 | Litman et al. | |
| 5,659,862 | A | | 8/1997 | Mahmud et al. | |
| 5,681,623 | A | * | 10/1997 | Ferralli | 427/483 |
| 5,765,286 | A | | 6/1998 | Sato et al. | |
| 5,942,287 | A | | 8/1999 | Christiansen et al. | |
| 5,997,772 | A | * | 12/1999 | Cornelius et al. | 252/507 |
| 6,063,511 | A | * | 5/2000 | Purinton et al. | 427/127 |

* cited by examiner

METHOD OF MANUFACTURING A DEVELOPER ROLLER

BACKGROUND OF THE INVENTION

This invention relates to a developer roller, and a method of making developer rollers used in image forming devices such as laser printers, photocopiers, or facsimile machines. Many of these image-forming devices make use of the same basic technology. These devices make use of a substance known as toner to print images on paper or other media. Toner is a fine dry powdery material. Toner is electrically chargeable, and may be magnetically attractable. The toner is typically contained in a section of a toner cartridge called the toner hopper and is transferred from the toner hopper toward a photoreactive drum or belt that contains a latent image. The latent image is an area of the drum that has a changed electrical charge in the shape of the image to be formed. Toner is electrically attracted to the latent image. The toner in the form of the latent image is then transferred to a sheet of paper or media and then fused on to the paper or to the media.

The toner is transferred from the toner hopper to an area adjacent to the photoreactive drum or belt by a developer roller. Developer rollers maybe used with both magnetic and non-magnetic toners. The most common type of the developer roller is the magnetic development roller and is used in the popular Hewlett Packard Laser Printer series.

A magnetic development roller is used with toner which is both magnetically and electrically attractable. An early embodiment was described in U.S. Pat. No. 3,219,014 issued to Mott et al. These developer rollers are generally rotatable hollow cylinders surrounding a fixed permanent magnet. These rollers are made of a variety of materials but all development rollers have needed to exhibit certain characteristics no matter what their make-up. First, the surface of the development roller must be electrically conductive. Second, the roller must have a texture so as to tribo-charge and carry the toner. The friction of the moving developer roller against a doctor bar or similar device imparts an electrical charge to the toner through tribo-charging. Third, the developer roller must be durable enough to maintain good performance throughout the useful life of the toner cartridge. Fourth, the developer roller must have good release characteristics so that the toner on the developer roller will leave the developer roller and go toward the latent image on the photoconductive drum. Fifth, in response to the electrical attraction, if the developer roller is a magnetic development roller, the developer roller should be magnetically transparent so as not to interfere with the magnetic field generated internally to the developer roller. The key problem in making a developer roller is balancing these qualities of durability and performance. Solutions for these characteristics include using a metallic developer roller such as that described in U.S. Pat. No. 5,749,033 to Swartz et al. Such a developer roller is electrically conductive, durable, has release characteristics, and may be textured by blasting the substrate. Others have used electrically conductive plastic materials as the surface of developer rollers. One such roller is described in U.S. Pat. No. 5,659,862 issued to Mahmud and another in U.S. Pat. No. 4,989,044 issued in Nishimura.

These prior art developer rollers have not fully achieved the release characteristics of the toner allowing the toner to move readily from the developer roller to the photoconductive drum or belt. By improving their release characteristics, toner transfer efficiency can be improved resulting in a better print with a lesser consumption of toner. With respect to the plastic coated developer rollers, great care must be taken to ensure uniform electrical conductivity at the surface of the developer roller together with uniform volumetric resistance below the surface. In addition, the prior art plastic coated rollers have used Phenolic resin as the binder material. Phenolic resin is friable and wears readily. The improved method producing the developer roller and the developer roller produced thereby described herein meets and solves these problems and is extremely efficient at transferring toner while maintaining a high degree of durability.

SUMMARY OF THE INVENTION

The developer roller of this invention has an electrically conductive substrate surrounded by multiple layers of a polymer containing finely ground graphite and wetting agent. These layers are spray applied in multiple passes. In a preferred embodiment the polymer graphite wetting agent mixture is diluted in a solvent until the solids are approximately 5% by weight of the spray. The wetting agent encourages even dispersion of the polymer graphite wetting agent mixture. By spraying in multiple fine layers good adhesion between layers is promoted. The use of a wetting agent encourages dispersion of the graphite uniformly throughout the material providing for better electrical characteristics, and the use of the wetting agent also promotes adherence between each sprayed layer and between the polymer-graphite-wetting agent layer and the substrate. Use of the wetting agent, therefore, provides for a more durable developer roller. A final top coat of essentially all graphite may be added to the polymer graphite wetting agent mixture. This final coating provides an extremely conductive, extremely lubricous coating and provides the qualities of toner release that are desired. This final coating is dispersed in a solvent, preferably isopropyl alcohol and spray applied. Again, the use of the wetting agent ensures good adherence between the graphite on the surface and the polymer-graphite-wetting agent layer below. The graphite wetting agent layer can then adhere to the graphite in the polymer and to itself creating an essentially all graphite surface that is maintained during the useful life of the developer roller. Multiple layers of the graphite wetting agent layer may be applied. After the essentially graphite and wetting agent layer is spray applied in multiple coats it is burnished with a goat hair brush or similar material to ensure that the graphite and wetting agent are pressed into the pores of the polymer material further promoting adherence. The burnishing may be done once, or multiple times as layers of graphite wetting agent are applied. The method making the developer roller described in this invention is easily automatable, uses readily available materials, and produces a durable developer roller with superior print characteristics.

BRIEF DESCRIPTION OF THE DRAWING

FIG. 2(*b*) is a cross section through the diameter of a magnetic development roller.

DESCRIPTION

The developer roller of the present invention and the method of making the same provides improved surface characteristics for efficient and complete transfer of toner from the developer roller to the photoreactive drum, and whose physical and chemical characteristics provide for a better adherence between the substrate and coating layers ensuring a more durable developer roller.

Figure 1:
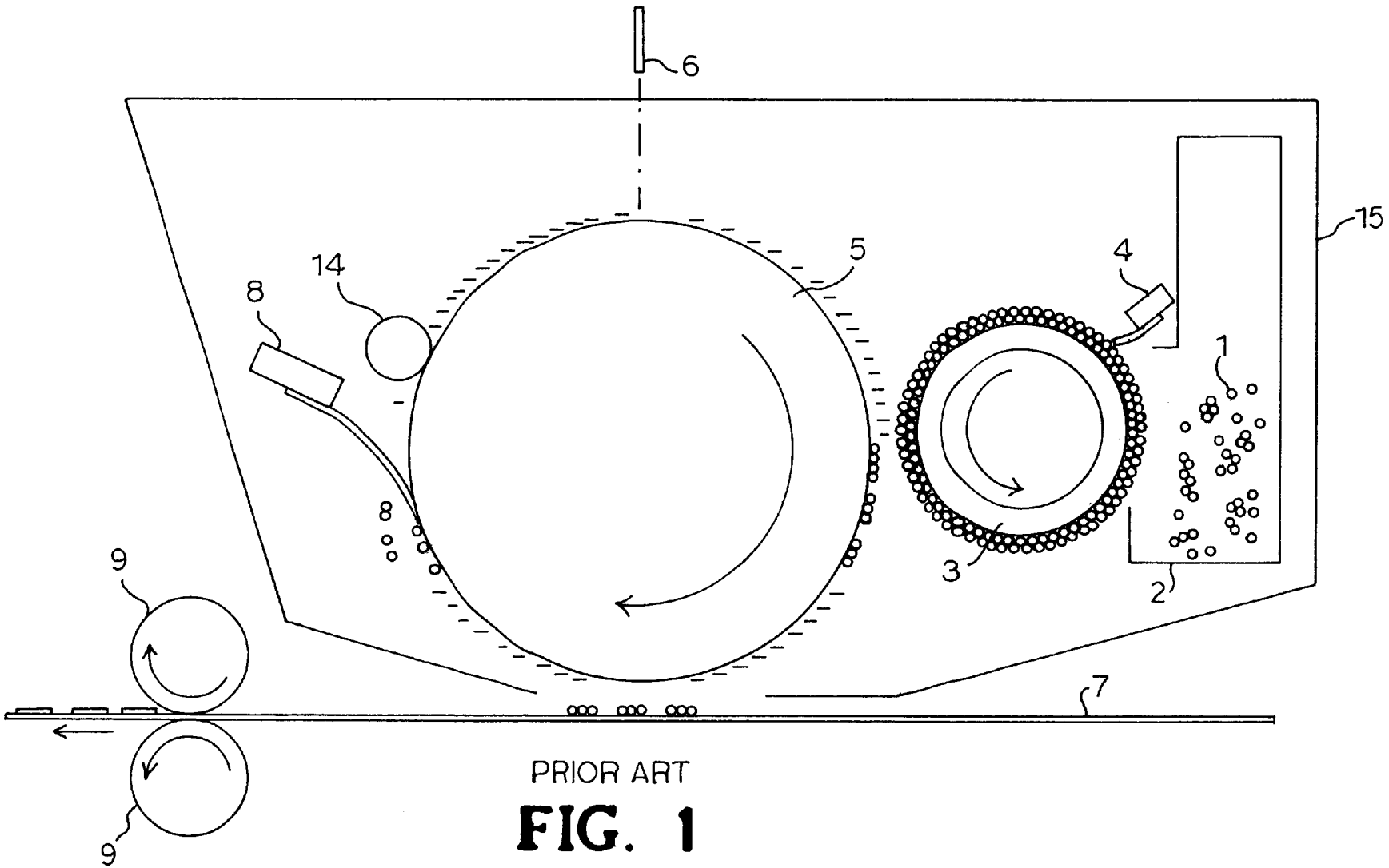
PRIOR ART FIG. 1
FIG. 1 is a schematic demonstrating the relationship between the developer roller, the toner, and other major components in a prior art toner cartridge.
Figure 2A:
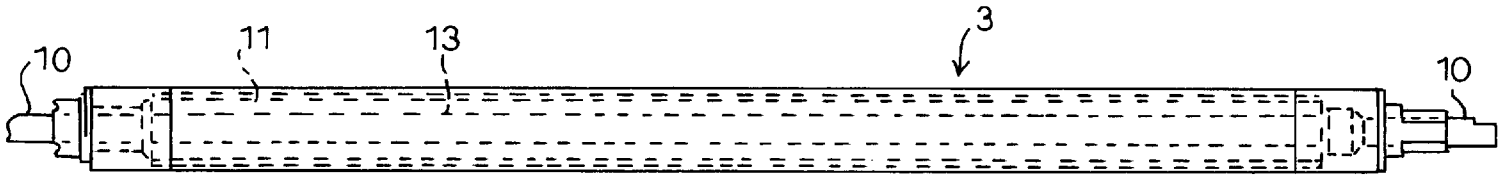
FIG. 2(*a*) is a side view of a magnetic developer roller.

FIG. 1 is a schematic of a prior art toner cartridge for use in an image-forming device. Toner 1 is contained in a container known as the toner hopper 2. The developer roller 3 rotates and attracts toner particles. A doctor blade 4 removes excess toner from the developer roller 3 as the developer roller 3 rotates. The photoreactive drum 5 is a charged cylinder coated with materials such as selenium, or more usually organic compounds which change charge in areas exposed to light. This photoreactive drum is charged by a device such as a primary charging roller 18 which may impart either a uniformly positive or a uniformly negative charge to the photoreactive drum 5. As the photoreactive drum 5 rotates past the primary charge roller 18, it is then illuminated by a laser 6. Those areas on the photoreactive drum 5 that are illuminated by the laser 6 change their charge becoming either relatively more positive or relatively more negative compared with the unilluminated areas on the surface on the photoreactive drum 5. In an analog copier reflected light takes the place of the laser 6. As the photoreactive drum 5 continues to rotate the illuminated areas on the surface of the photoreactive drum 5 move adjacent to the developer roller 3. Toner 1 on the surface of the developer roller 3 is attracted to the differentially charged areas on the photoreactive drum 5. The drum continues to rotate. The toner on the drum is brought in proximity to paper or other media 7. This media 7 has been charged to attract the toner. The toner 1 moves to the media 7 in the image written on the photoreactive drum 5 by the laser 6. The media then moves through fusing rollers 9 which melt the toner onto the media 7 providing a permanent image. The developer roller 3 rotates adjacent to the toner 1. The developer roller may magnetically attract toner 1 to its surface if it is a magnetic development roller or it may attract toner electrostatically if it is a non-magnetic toner 1. As the developer roller rotates, the toner 1 is brought adjacent to a doctor blade 4 which meters the amount of toner 1 on the surface of the developer roller 3. The friction between the doctor blade 4 and the developer roller 3 helps to tribo-charge the toner 1 to the desired electrical charge. This charged toner 1 can then move to the differentially charged areas of the photoreactive drum 5.

Figure 5:
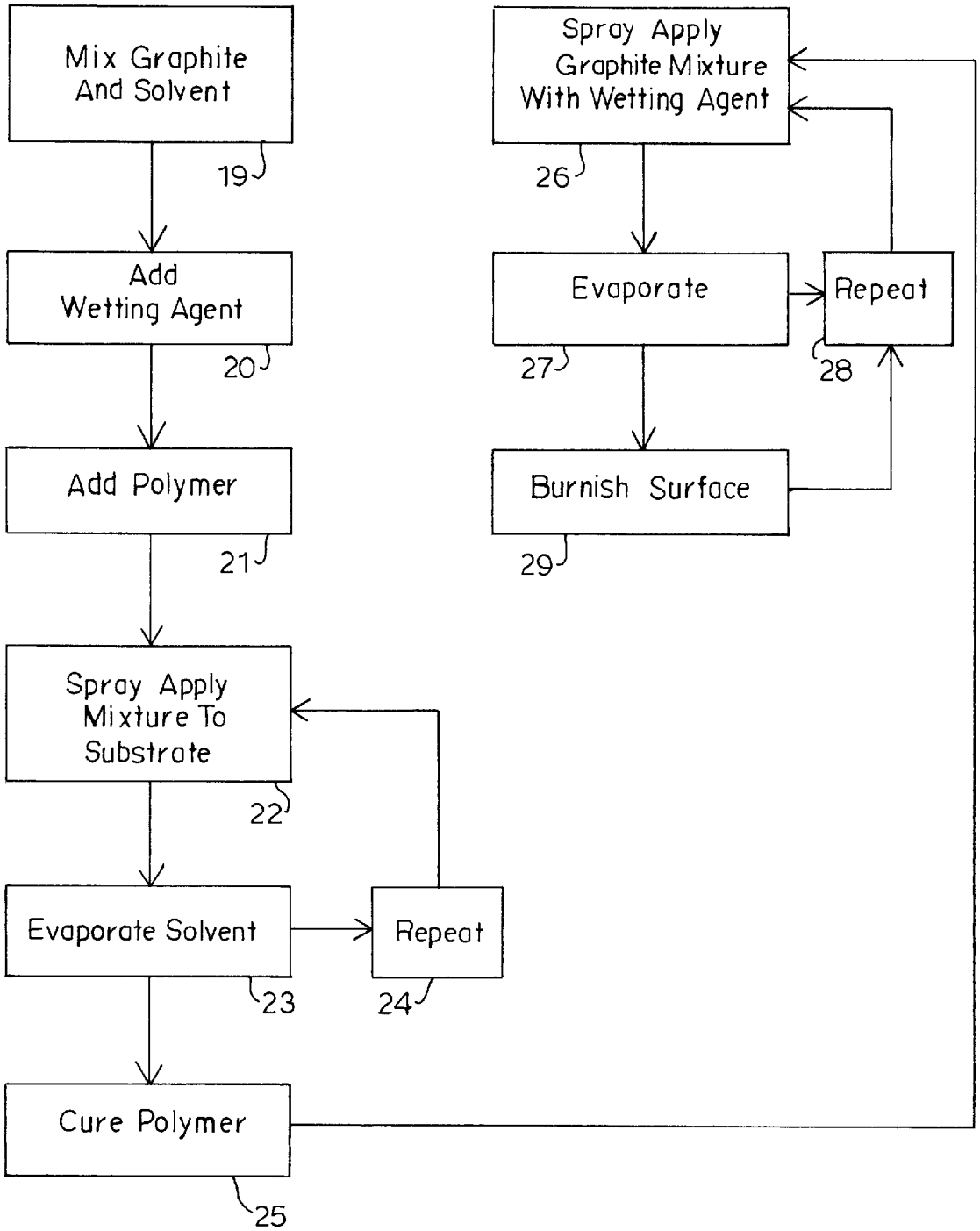
FIG. 5 is a flow chart indicating the method of making a developer roller of this invention.

The friction between the toner i and the mag roller 3 and the developer roller 4 causes wear on the surface of the developer roller 3. FIG. 5 illustrates this interaction. The surface of the developer roller 3 is textured to assist in the tribo-charging process and to improve the toner carrying characteristics of the developer roller 3. If the surface of the developer roller 3 is not durable then friction will wear away the textured profile of the developer roller decreasing toner transfer and tribo-charging of the toner. The outer surface of the developer roller 12 must also be lubricious. If it is not, then particles of toner may adhere to the developer roller and not transfer to the drum. A layer of adhered, non-transferring toner will further decrease the quality of the print.

Figure 3:
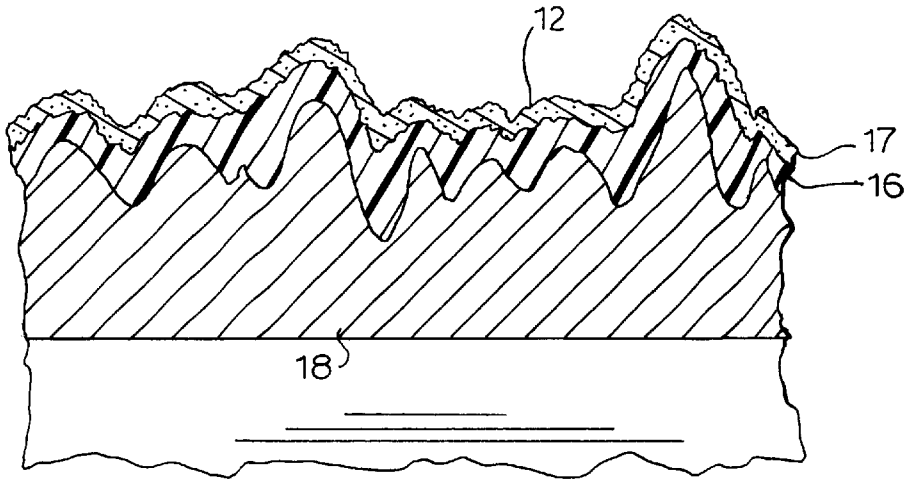
FIG. 3 is a cross section of the developer roller of this invention showing the relationship between the developer roller substrate and the other layers making up the developer roller of this invention.
Figure 2B:
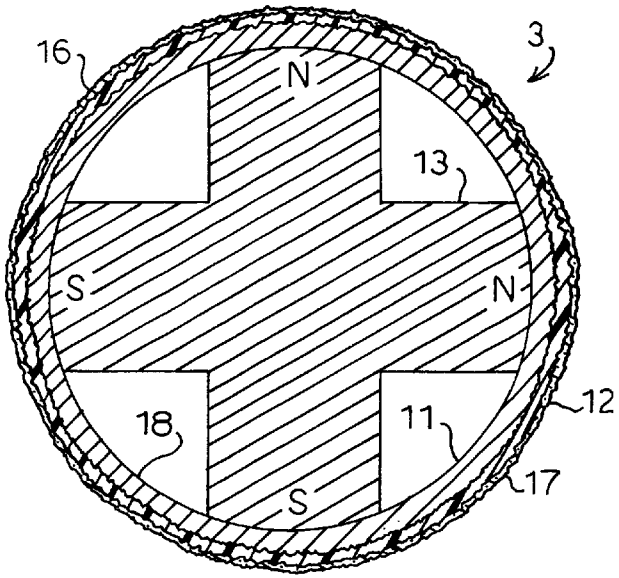
Figure 4:
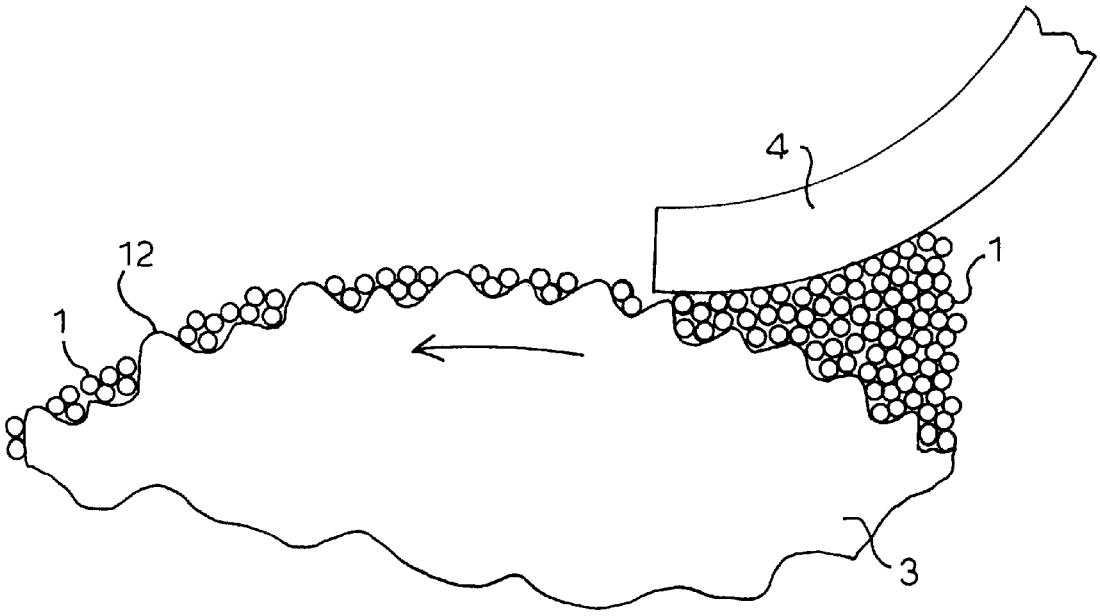
FIG. 4 is a view of a typical developer roller and a doctor blade.

The present invention provides this required level of durability and lubriciousness by having an outer layer of essentially all graphite 17 together with the wetting agent over a durable layer of polymer graphite and wetting agent that have been applied in multiple fine layers. Turning to FIG. 3, a cross section of the developer roller of this invention can be seen. The outer surface 12 of the developer roller is the outer surface of the essentially all graphite layer 17. Below this is a layer of polymer, graphite, and wetting agent 16 over the developer roller substrate 18. The developer roller substrate 18 is preferably aluminum, but which could also be of an electrically conductive polymer, or other metal. The advantage of this construction and the method of making the same are explained below.

The method of making a developer roller is illustrated in FIG. 5 and a s follows: First, a graphite mixture 19 must be prepared. The graphite particles must be reduced to a relatively uniform and small size preferably in the range of 0.3 to 10 microns. Graphite is milled with a suitable solvent in a vibratory, ball or attrition mill. Although a variety of solvents may be used, the preferred embodiment is a mixture of PMA (propylene glycol methyl ether acetate) and acetone. The solvent should be selected to have a sufficiently low boiling point to dry readily and therefore prevent drips or runs, but a sufficiently high boiling point to insure an even coating when spray applied. After milling the graphite to a suitable size, a wetting agent is added 20. A wetting agent is a product designed to ensure the singulation of particles and thorough mixing of the particles in the solution. Wetting agents include a variety of substances that are well known for their dispersing qualities in the paint industry. What is not well known is that these wetting agents also promote adhesion. The inventors have discovered the use of a wetting agent promotes adhesion of the polymer-graphite-wetting agent layer 16 to the developer roller substrate 18, and promotes adhesion of the polymer-graphite wetting agent to one another. In the preferred embodiment the wetting agent Antiterra U manufactured by BIC Chemie is used. Other wetting agents may be used. The proportions of graphite to a wetting agent are preferably approximately 50 to 1, but other proportions will provide satisfactory results.

In the next step a suitable polymer is added to the graphite and wetting agent mixture 21 and mixed in one of a number of suitable mills to ensure thorough dispersion of all the constituents. Although a variety of polymers may be used, in the preferred embodiment an elastomeric elastic polymer, preferably a two-part blocked heat activated polyurethane is used. An elastomeric polymer provides additional toughness and resiliency to the developer roller. This polymer-graphite wetting-agent combination has, in the preferred embodiment, 60 parts polymer to 40 parts graphite and wetting agent. This mixture is further diluted in solvents to a solid content of about 5%. The wetting agent in the polymer-graphite-wetting-agent mixture further ensures good dispersion of the materials throughout the solution.

After preparing a suitable polymer-graphite-wetting agent solution, the next step is to provide an electrically conductive textured substrate 18. Although an electrically conductive molded plastic may be used, in the preferred embodiment a piece of textured aluminum is used. The electrically conductive substrate 18 is in the form of a cylinder or tube. If aluminum the tube may be formed by extrusion, or by boring. After the tube is formed in the appropriate diameter and length, the tube is next textured. Texturing can occur in a variety of methods including media blasting, or vibratory finishing. In the preferred embodiment, media blasting using glass media is used. After texturing, the developer roller substrate 18 is now ready for coating. The purpose of the polymer-graphite-wetting-agent layer 16 is to provide a wear resistant substrate which can assist in maintaining a graphite rich surface. It provides better qualities to the developer roller substrate than could exist without such a coating. For example, if the developer roller substrate 18 is aluminum and is not coated, it will oxidize changing its performance characteristics. Also, aluminum is relatively soft, and would readily wear from abrasion by the toner 1 and the doctor blade 4.

The polymer-graphite wetting-agent layer 16 is applied by spraying 22 the material onto the electrically conductive substrate 18. The polymer-graphite wetting-agent layer is preferably applied by spraying 22 multiple fine coats with an air brush or similar sprayer on the developer roller substrate 18. By using multiple small sprays of highly diluted polymer-graphite wetting-agent, an even coating of material is ensured and a better adherence between the coatings is ensured. Here again, the wetting agent serves a crucial function. Wetting agents improve the bonding between layers of material, and between dissimilar materials. The inventors have experimented with applying this same material in a single spray and without a wetting agent and have found that multiple sprays, using a wetting agent, preferably twenty or more, greatly improve the bond between the polymer graphite wetting agent layer and the developer roller substrate 18.

Spray application of the polymer-graphite wetting-agent layer occurs in multiple passes. After each pass the developer roller substrate, and the partially applied polymer graphite wetting agent layer 16 are oven dried to drive off or evaporate 23 the solvent. After drying the developer roller substrate 18 and partial coating of the polymer-graphic-wetting agent are cooled and another pass of polymer-graphite-wetting agent material may be spray applied 22. This step may be repeated 24 as often as desired, preferably 20–30 times in layers that are between about 0.03 microns to 1.25 microns thick. The thickness of the polymer-graphite wetting agent layer 16 may vary, but in the preferred embodiment is about 1 to 25 microns. After all the desired material has been applied to the developer roller substrate 18, the blocked polyurethane is then cured or cross linked 25 by heating the developer roller substrate 18 and polymer graphite wetting agent layer 16. This further improves adherence between the sprayed layers and the polymer graphite wetting agent layer 16 and the developer roller substrate 18.

The graphite-wetting agent layer 17 is prepared in a similar fashion to the preparation of the graphite and wetting agent before adding the polymer. Graphite is reduced to a fine size in a suitable mill, preferably a vibratory mill together with a solvent. In this case the solvent is preferably isopropyl alcohol. A higher boiling point solvent may be used for this layer since even dispersion will be aided by burnishing. A wetting agent is then added to the graphite solvent mixture. In the alternative, the wetting agent may be added to the graphite in the milling process. In the preferred embodiment, the ratio between the graphite and the wetting agent is 50 to 1 although other proportions will produce satisfactory results. BIC Chemie's AntiTerra U is again the preferred wetting agent although others may be used.

The graphite wetting agent mixture is then further diluted until the solid content is approximately 3% of the solution. The graphite-wetting agent layer 17 is then spray applied 26 using an airbrush or similar fine spray applicator to the surface of the polymer-graphite wetting agent layer 16. The wetting agent in the graphite wetting agent layer ensures good adherence between the exposed graphite particles and the polymer graphite wetting agent layer and the graphite in the graphite wetting agent layer. Spray application 26 of the graphite wetting agent layer 17 may be repeated 28 in multiple passes, preferably 3 or more, possibly as many as 20 passes. After spray applying each layer of graphite wetting agent, that layer is allowed to evaporate 27, driving off the solvent. The essentially all graphite layer 17 is burnished 29 in order to spread the graphite evenly over the surface of the developer roller and to drive the graphite wetting agent material into the pores and gaps of the polymer graphite wetting agent layer. Burnishing 29 ensures a strong bond between the graphite wetting agent on the surface layer and the graphite in the polymer below. This bond provides an essentially all graphite layer 17 at the outer surface 12 of the developer roller 3. Burnishing 29 may be repeated 28 after each pass or may be repeated 28 after a number of layers of the graphite wetting agent layer have been applied.

By providing a surface layer of essentially all graphite, the present developer roller has excellent electrical and lubricious characteristics providing for full release of the toner. The essentially all graphite layer is able to maintain itself through the useful life of the developer roller because the wetting agent ensures that the graphite adheres strongly to the surface of the polymer graphite wetting agent layer. By use of a resilient elastomeric polymer such as polyurethane, wear of the polymer graphite wetting agent layer is reduced or eliminated.

The developer of the roller of this invention offers further advantages. The developer roller may be reused after the initial cycle, by cleaning the developer roller and repeating the application of a layer of essentially all graphite and wetting agent. Thus, the developer roller may be reused providing significant advantages to the environment and reduction of steps necessary to make a developer roller and of cost to the end-user. This developer roller is particularly useful for persons or companies who remanufacture toner cartridges. A remanufactured toner cartridge is one that has been used once, and has been restored by adding additional toner, and replacing the worn out components. The developer roller of this invention lends itself readily to being restored by renewing the surface layer of graphite. Although the inventors have made reference to particular materials, other alternate materials and inventions well known to those skilled in the art are within the spirit and scope of this invention.

We claim:

1. A method of manufacturing a developer roller for use in an image forming device, said method comprising the steps of:

a) Providing an electrically conductive substrate, b) Mixing a polymer with finely ground graphite and a wetting agent with a sprayable solvent forming a mixture of polymer, graphite, and wetting agent and solvent, c) Spray applying said mixture of polymer, graphite, wetting agent and solvent on the electrically conductive substrate to form a polymer-graphite-wetting agent layer.

2. A method as in claim 1 further comprising applying more than one polymer-graphite-wetting agent layer.

3. A method as in claim 2 wherein the polymer-graphite-wetting agent layers are applied in more than twenty coats.

4. A method as in claim 3 further comprising the step of oven drying the developer roller after spraying a layer of polymer-graphite-wetting agent.

5. A method as in claim 4 further comprising the step of air cooling the developer roller after each step of drying the developer roller and before applying the next coat.

6. A method as in claim 5 wherein the polymer is a two-part heat activated blocked polyurethane.

7. A method as in claim 6 further comprising the step of heating the coated roller to cross-link the polyurethane.

8. A method as in claim 1 wherein the polymer graphite wetting agent layer is about 60% polymer, about 40% graphite and less than about 1% wetting agent by weight.

9. A method as in claim 8 wherein the graphite and wetting agent are thoroughly mixed by placing them in a vibratory mill for more than three days before adding the polymer.

10. A method as in claim 1 further comprising the step of thoroughly mixing the graphite and wetting agent in the solvent before adding the polymer.

11. A method as in claim 1 further comprising diluting the polymer-graphite-wetting agent and solvent mixture in additional solvent until the polymer-graphite-wetting agent in the mixture is less than 5% of the mixture by weight.

12. A method as in claim 1 wherein the solvent is a mixture of PMA and acetone.

13. A method as in claim 1 further comprising the step of thoroughly mixing the graphite and wetting agent in a second solvent, and spray applying a graphite rich layer of graphite and wetting agent in a layer on top of the polymer-graphite-wetting agent layer.

14. A method as in claim 13, wherein the graphite rich layer is applied in multiple coats.

15. A method as in claim 14 further comprising the step of drying the second solvent from the graphite rich layer.

16. A method as in claim 15 further comprising the step of burnishing the graphite rich layer to ensure an even surface coat of essentially all graphite, and to aid adherence of the graphite to the polymer-graphite-wetting agent layer.

17. A method as in claim 13 wherein the second solvent is isopropyl alcohol.

18. A method as in claim 13 wherein the graphite rich layer has a conductivity greater than the conductivity of the polymer graphite wetting agent layer.

19. A method as in claim 13 wherein the graphite rich layer has a conductivity greater than the conductivity of the polymer-graphite-wetting agent layer.

20. A method as in claim 1 wherein the graphite particles average about six microns in size.

21. A method as in claim 1 wherein the electrically conductive substrate is an Aluminum tube.

22. A method as in claim 1 wherein the electrically conductive substrate is an Aluminum tube.

23. A method of manufacturing a developer roller for use in an image forming device, said method comprising the steps of:

a) Providing an electrically conductive substrate, b) Mixing a polymer with finely ground graphite and a wetting agent with a sprayable solvent forming a mixture of polymer, graphite, wetting agent and solvent, c) spray applying a thin layer of said mixture of polymer, graphite, wetting agent and solvent on the electrically conductive substrate to form a thin layer of polymer-graphite-wetting agent on the electrically conductive substrate.

24. A method as in claim 23 wherein the thin layer of polymer-graphite-wetting agent has a thickness of between about 1.25 microns and about 0.03 microns.

25. A method as in claim 24 further comprising the step of air cooling the developer roller after each step of drying the developer roller and before applying the next layer of polymer-graphite-wetting agent.

26. A method as in claim 23 further comprising applying more than one the polymer-graphite-wetting agent layer.

27. A method as in claim 23 further comprising the step of applying about 20 to 30 polymer-graphite-wetting agent layers.

28. A method as in claim 23 further comprising the step of oven drying the developer roller after spraying the layer of polymer-graphite-wetting agent.

29. A method as in claim 23 wherein the polymer-graphite-wetting agent layer is about 60% polymer, about 40% graphite and less than about 1% wetting agent by weight.

30. A method as in claim 23 further comprising the step of thoroughly mixing the graphite and wetting agent in the solvent before adding the polymer.

31. A method as in claim 23 further comprising diluting the polymer-graphite-wetting agent and solvent mixture in additional solvent until the polymer-graphite-wetting agent in the mixture is less than 5% of the mixture by weight.

32. A method as in claim 31 further comprising the step of heating the coated roller to cross-link the polyurethane.

33. A method as in claim 32 further comprising the step of drying the second solvent from the graphite rich layer.

34. A method as in claim 23 wherein the solvent is a mixture of PMA and acetone.

35. A method as in claim 23 wherein the polymer is a two-part heat activated blocked polyurethane.

36. A method as in claim 35, wherein the graphite rich layer is applied in multiple coats.

37. A method as in claim 35 further comprising the step of burnishing the graphite rich layer to ensure an even surface coat of essentially all graphite, and to aid adherence of the graphite to the polymer-graphite-wetting agent layer.

38. A method as in claim 35 wherein the second solvent is isopropyl alcohol.

39. A method as in claim 23 further comprising the steps of mixing graphite and wetting agent in a second solvent, and spray applying a graphite rich layer of graphite and wetting agent in a layer on top of the polymer-graphite-wetting agent layer.

* * * * *